United States Patent [19]

True et al.

[11] 4,442,736

[45] Apr. 17, 1984

[54] POWER PIPE TONG ROTARY PLUNGER INSERTER

[75] Inventors: Martin E. True; Terry D. Timmerman, both of Houston, Tex.

[73] Assignee: Weatherford/Lamb, Inc., Houston, Tex.

[21] Appl. No.: 416,405

[22] Filed: Sep. 9, 1982

[51] Int. Cl.[3] ..... B25B 17/00

[52] U.S. Cl. ..... 81/57.15

[58] Field of Search ..... 81/57.15, 57.16, 57.17, 81/57.18, 57.19, 57.20, 57.21; 192/135

[56] References Cited

U.S. PATENT DOCUMENTS

| | | | |
|---|---|---|---|
| 4,095,493 | 6/1978 | Haynes | 81/57.15 |
| 4,170,907 | 10/1979 | Cathcart | 81/57.15 |
| 4,334,444 | 6/1982 | Carstensen et al. | 81/57.18 |
| 4,371,069 | 2/1983 | Lovegrove | 81/57.15 X |

*Primary Examiner*—James L. Jones, Jr.
*Attorney, Agent, or Firm*—Fulbright & Jaworski

[57] ABSTRACT

In a power pipe tong including doors with a latch handle and having a circular rotary with connecting ends for opening and closing and receiving pipe for make-up or break-out in which the connecting ends of the rotary are fastened together by a spring loaded plunger, the improvement in means for inserting the plunger into the connecting ends as the tong doors are closed and preventing the plunger from becoming disengaged until the doors are opened. A cam is pivotally mounted, on the tong in position for engagement with the top of the plunger for inserting the plunger into the rotary and for releasing the plunger. A connecting linkage mechanism pivotally connects between the cam and the door latch handle and is actuated by the handle for moving the cam into engagement with the plunger when the latch is closed and moves the cam out of engagement with the plunger when the latch is opened. An actuating spring is positioned between the tong and the handle which is cocked when the handle is opened and which actuates the latch to the closed position for actuating the cam when the doors are closed. A spring biased trigger on one of the doors engages and locks the latch handle in the open position when the latch is opened and a releasing pin on the other door engages and unlocks the trigger from the latch handle when the doors are moved to the closed position.

9 Claims, 10 Drawing Figures

POWER PIPE TONG ROTARY PLUNGER INSERTER

BACKGROUND OF THE INVENTION

Power pipe tongs utilize a rotary that opens to receive or discharge pipe for make-up or break-out and which closes around the pipe to form a continuous rotary for gripping the pipe. The rotary is segmented and includes connecting ends which are fastened together by a spring loaded plunger. Normally in the past the plunger has been inserted by rotation of the rotary that moves the upper end of the plunger along an incline on the tong which forces the plunger into the connecting ends and further rotation of the rotary results in the tongs gripping the pipe which applies a sufficient force on the rotary plunger to maintain it in the engaged position. However, when the rotary rotates without gripping the pipe the plunger disengages and engages from the rotary as the rotary revolves because the plunger is biased upwardly.

The present invention is directed to a mechanism for inserting the plunger into the connecting ends of the rotary when the doors are closed and for preventing the plunger from becoming disengaged until the doors are opened which results in a smoother and safer tong operation.

SUMMARY

The present invention is directed to a power pipe tong including doors with a latch handle and having a circular rotary with connecting ends for opening and closing for receiving and discharging pipe for makeup or break-out in which the connecting ends of the rotary are fastened together by a spring loaded plunger by providing an improvement in means for inserting the plunger into the connecting ends as the tong doors are closed and preventing the plunger from becoming disengaged until the doors are opened.

A still further object is the provision of a cam pivotally mounted on the tong in position for engagement with the top of the plunger for inserting the plunger into the rotary and for releasing the plunger. A connecting linkage is connected between the cam and the door latch handle and is actuated by the handle for moving the cam into engagement with the plunger when the latch is closed and for moving the cam out of engagement with the plunger when the latch is opened.

Still a further object of the present invention is wherein a spring biased trigger is provided on one of the doors for engaging and holding the latch handle in the open position when the latch is open. A releasing pin is positioned on the other door for engaging and unlocking the trigger from the latch handle when the doors are moved to the closed position.

Yet a still further object is the provision of an actuating spring means positioned between the tong and the handle which is cocked when the handle is opened and which actuates the latch to the closed position and thereby actuates the cam when the doors are closed.

A still further object is wherein the connecting linkage includes a connecting link pivotally connected to the handle and a crank pivotally connected to the link and to the cam.

Yet a further object of the present invention is wherein the cam includes an incline for engaging and moving the plunger downwardly and includes a horizontal stop for holding the plunger in the engaged position.

Still a further object of the present invention is wherein the cam may be actuated in a horizontal or a vertical direction to actuate the plunger.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
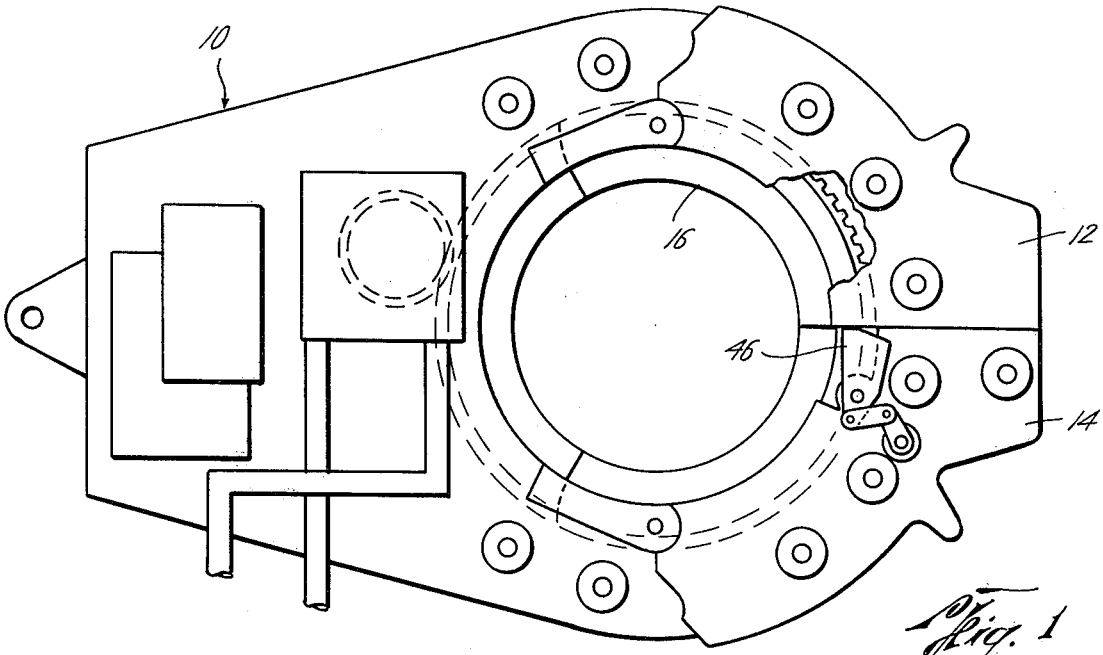
FIG. 1 is an elevational view of a power pipe tong utilizing the present invention.
Figure 2:
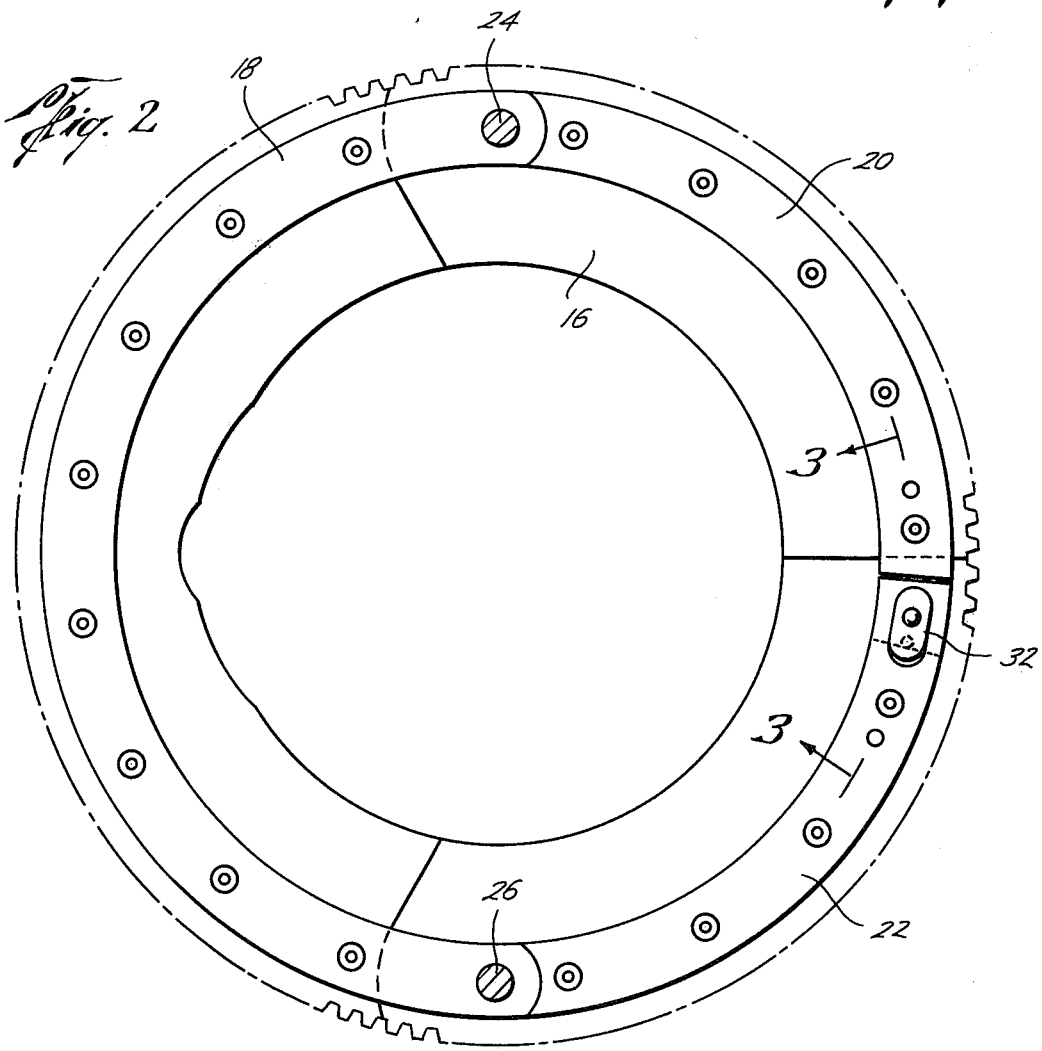
FIG. 2 is an enlarged elevational view of the rotary of the pipe tong of FIG. 1.
Figure 3:
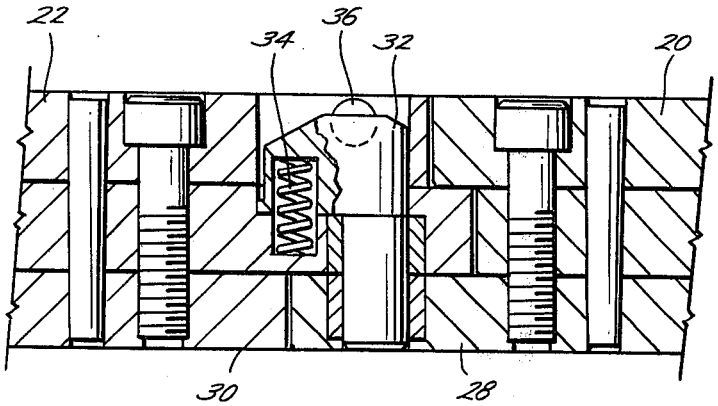
FIG. 3 is a cross-sectional view taken along the line 3—3 of FIG. 2.

Referring now to the drawings, and particularly to FIG. 1, the reference numeral 10 generally indicates a power pipe tong such as a Weatherford/Lamb casing tong which generally includes doors 12 and 14 and a rotary 16 on which jaws (not shown) are attached for gripping pipe for making up or breaking out joints of pipe. As best seen in FIGS. 2 and 3, the rotary 16 generally consists of three segments 18, 20 and 22. Segements 18 and 20 are connected together by a pin 24 and segments 18 and 22 are connected together by a pin 26. The segments 20 and 22 include connecting ends 28 and 30, respectively. A plunger 32 is provided which engages the connecting ends 28 and 30 to maintain them in a connected position. The plunger 32 is spring loaded by a spring 34 in a direction to remove the plunger 32 from and release the connecting ends 28 and 30. The plunger 32 also includes a roller 36. In a conventional tong, as the rotary 16 is rotated, the roller 36 will contact a ramp on the tong to move the plunger downwardly into engagement with the connecting ends 28 and 30. When the tong 10 grips pipe positioned inside of the rotary 16, the plunger 32 is held in a connecting position in the ends 28 and 30 by friction. However, when the rotary 16 rotates without gripping pipe, the plunger 32 is alternately engaged and disengaged from the rotary 16 as it rotates in the tong. In some instances, the rotary 16 has gripped pipe without the plunger 32 becoming engaged which has resulted in considerable damage to the tong 10 and created a safety hazard to the operator.

The above description of the structure and operation of a tong is conventional. However, the present invention is directed to providing a smoother and safer tong operation by insuring that the plunger 32 is inserted into the connecting ends 28 and 30 when the tong doors 12 and 14 are closed and preventing the plunger 32 from becoming disengaged until the tong doors 12 and 14 are opened for receiving or discharging pipe from the interior of the rotary 16.

Figures 4, 5:
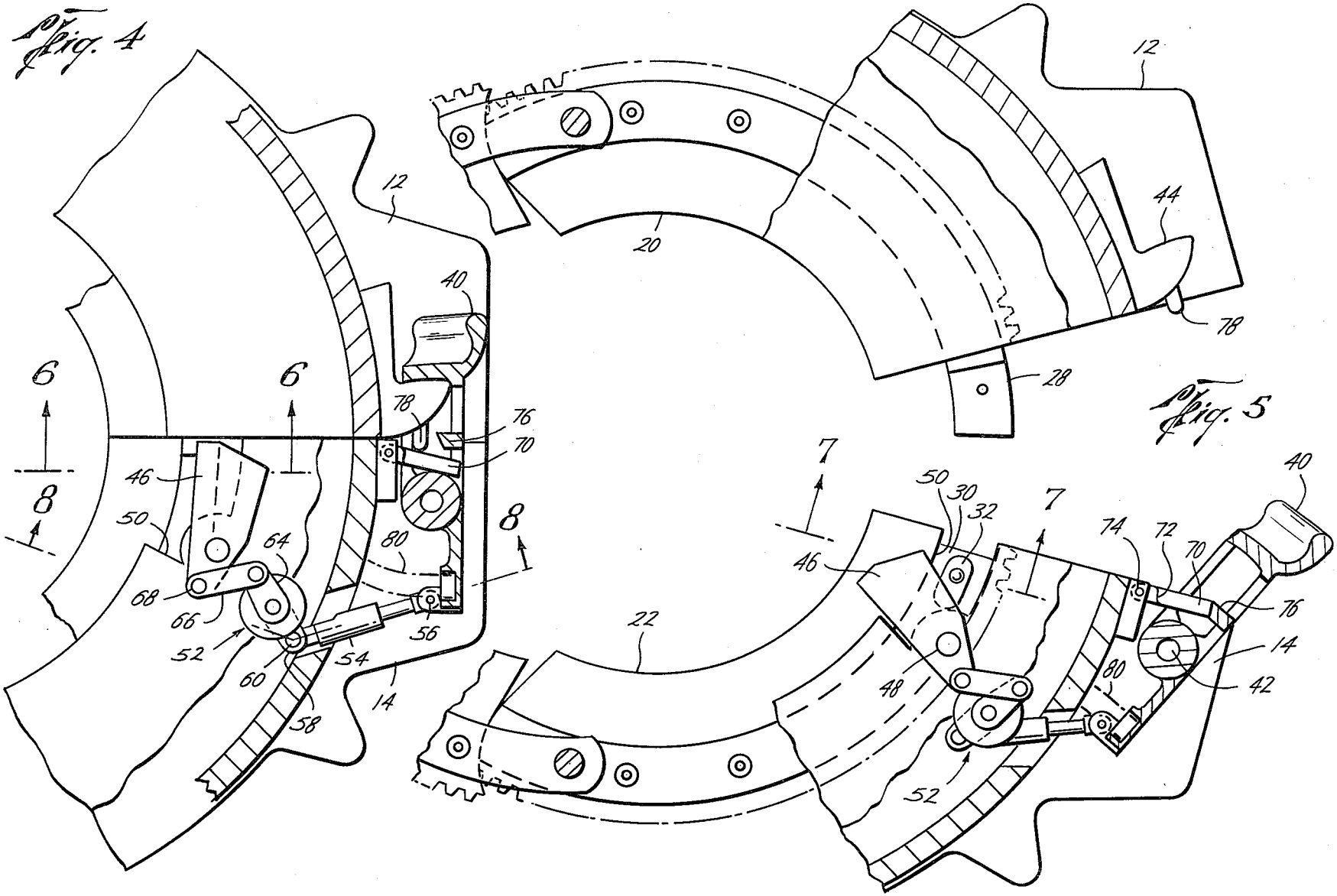
FIG. 4 is a fragmentary elevational view, in cross section, illustrating one embodiment of the present invention shown in position with the tong doors closed.
FIG. 5 is a fragmentary elevational view, in cross section of the embodiment of FIG. 4 in position when the tong doors are open.

Referring to FIGS. 4 and 5, the tong 10 also includes a latch handle 40 which is pivotally connected to one of the doors, such as 14, by a pivot 42 and which engages a lug 44 on the other door, such as 12, for locking and unlocking the doors 12 and 14 together.

Figure 7:
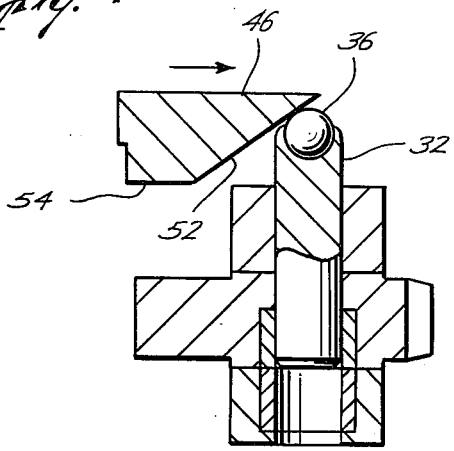
FIG. 7 is a cross-sectional view taken along the line 7—7 of FIG. 5.
Figure 6:
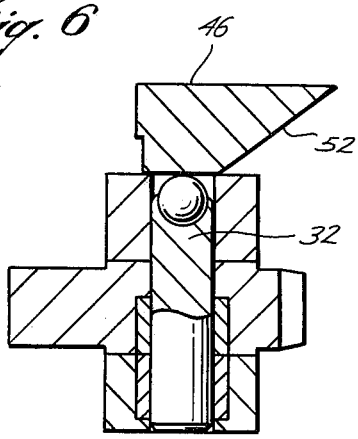
FIG. 6 is a cross-sectional view taken along the line 6—6 of FIG. 4.
Figure 9:
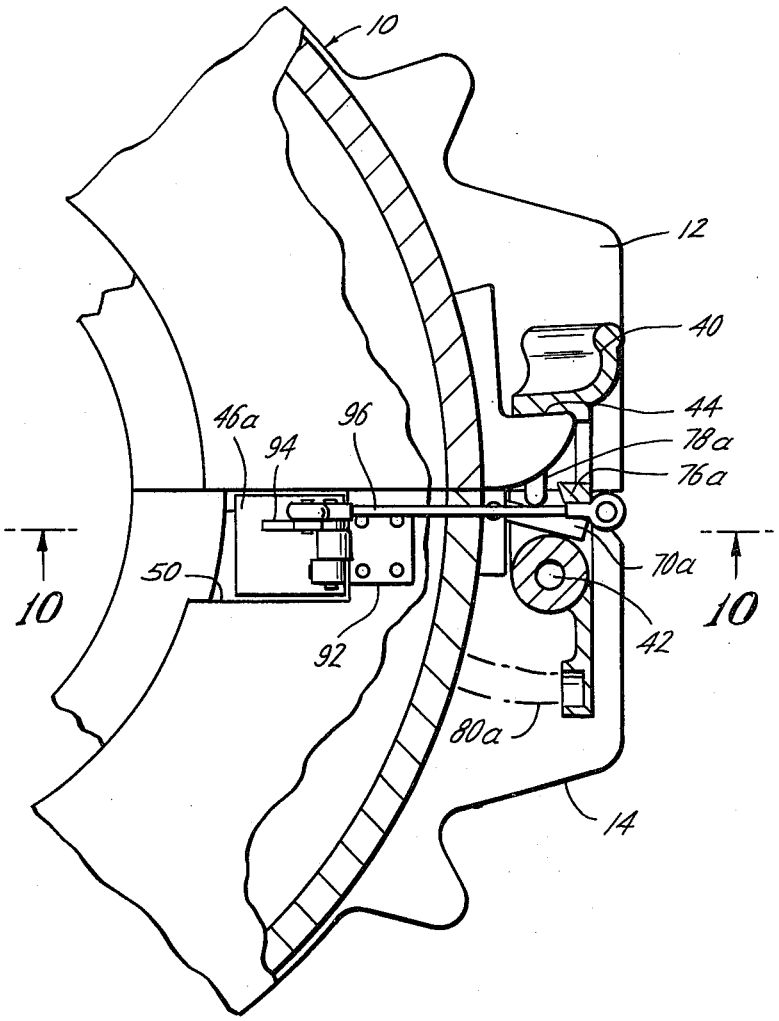
FIG. 9 is a fragmentary elevational view of another embodiment of the present invention.
Figure 10:
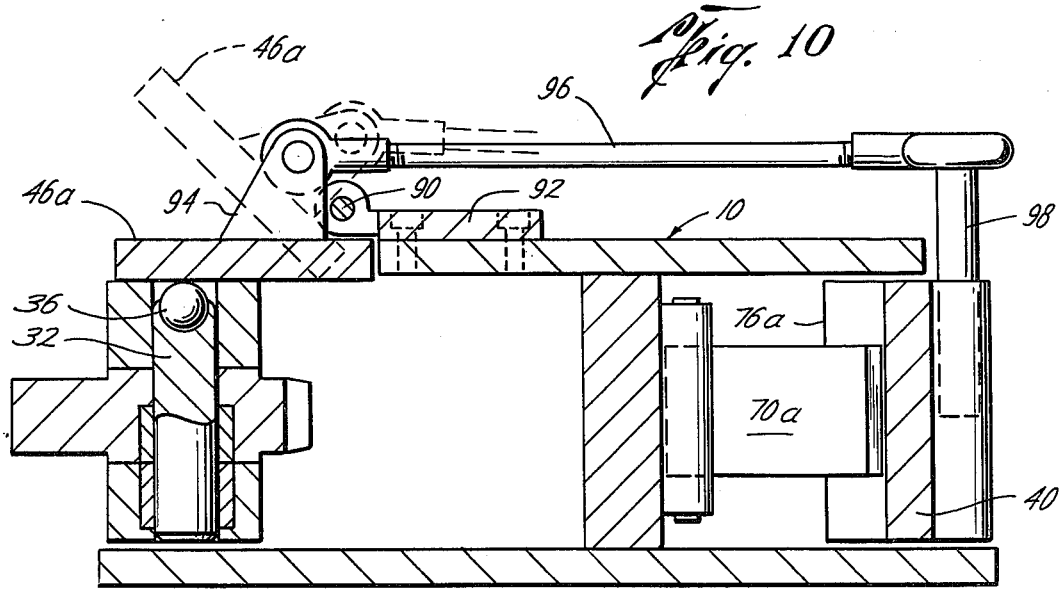
FIG. 10 is a cross-sectional view taken along the line 10—10 of FIG. 9.

Referring now to FIGS. 1, 4 and 5, the present invention is directed to providing a cam 46 which is pivotally mounted about a pin 48 on the tong 10 for horizontal movement over the window 50 in the tong housing for engagement with the top of the plunger 32 for moving the plunger downwardly and inserting it into the rotary 16 and for retraction away from the window 50 for releasing the plunger 32. While the cam 46 can be actuated in a vertical direction, as shown in the embodiment of FIGS. 9 and 10, the embodiment of FIGS. 1–8 rotates the cam 46 in a horizontal plane. As best seen in FIGS. 6 and 7, the cam 46 includes an incline surface 52 and a horizontal stop 54 whereby when the cam 46 is moved over the plunger 32 the incline surface 52 will contact the top of the plunger 32 such as the roller 36 moving the plunger 32 downwardly and overcoming the biasing spring 34 and on further movement the stop surface 54 will move over the top of the plunger 32 and securely hold the plunger 32 in a connected position.

The cam 46 is actuated to automatically move the cam into engagement with the plunger 32 when the doors 12 and 14 are closed and for moving the cam out of engagement with the plunger 32 when the doors 12 and 14 are opened. In order to actuate the cam 46 a connecting linkage mechanism generally indicated by the reference numeral 52 is connected between the cam 46 and the latch handle 40 whereby the cam 46 is actuated by the handle 40.

Figure 8:
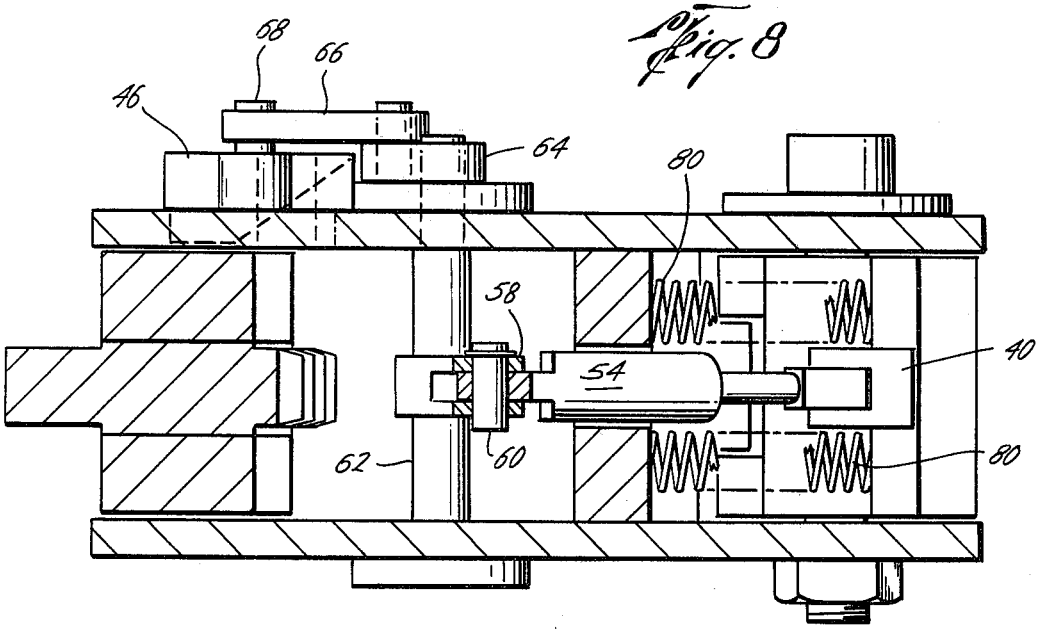
FIG. 8 is a cross-sectional view taken along the line 8—8 of FIG. 4.

While the mechanism 52 may be of various types, as best seen in FIGS. 4, 5 and 8, the mechanism 52 may include a link 54 which is pivotally connected to the latch handle 40 by pin 56 and in turn is pivotally connected to a crank 58 by a pin 60. The crank 58 is connected to and rotates a shaft 62. Rotation of shaft 62 rotates an arm 64 which in turn is pivotally connected to a second link 66 which is in turn pivotally connected to the cam 46 by a pivot 68. Therefore, as best seen in FIG. 4, when the doors 12 and 14 are closed and the latch handle 40 is moved to the latched position the mechanism 52 rotates the cam 46 over and causes the plunger 32 to be inserted in the connecting ends 28 and 30 in the rotary 16. On the other hand, when the latch handle 40 is opened the connecting linkage mechanism 52 is actuated to rotate the cam 46 off of the plunger 32 whereby the spring 34 may cause the plunger 36 to move upwardly releasing the connecting ends 28 and 30 and as the doors 12 and 14 are opened and a pipe joint may be inserted or removed from the inside of the rotary 16.

Another feature of the present invention is the provision of a trigger mechanism which will insure that when the doors 12 and 14 are opened that the cam 46 releases the plunger 32 for allowing the connecting ends 28 and 30 to be opened and closed for passage of pipe joints. Thus, a trigger 70 is provided which is spring loaded by a spring 72 and pivotally connected by a pivot pin 74 to one of the doors, such as 14, for moving outwardly and engaging a lug 76 on the latch handle 40 for holding the latch handle 40 in the open position, as best seen in FIG. 5, thereby maintaining the cam 46 in the retracted position away from the plunger 32. A releasing pin 78 is provided on the other door, such as door 12, which, when the doors 12 and 14 are closed, will engage the trigger 70 and move it off of the lug 76 allowing the latch handle 40 to be closed, as best seen in FIG. 4. It is also desirable that the actuation of the latch handle 40 and the cam 46 to the closed position be automatic. Therefore, one or more springs 80 are provided between the body of the tong and the latch handle 40. Thus, when the latch handle 40 is opened the springs 80 will be compressed and cocked and held in the cocked position by the trigger 70. However, when the doors are closed the releasing pin 78 engages and unlocks the trigger 70 and the springs 80 will automatically close the latch handle 40 and actuate the cam 46 to engage and move the plunger 32 to a locking position.

In operation, the tong operates conventionally to rotate and make up or break out pipe joints by jaws secured to the rotary 16. When it is desired to open the tong 10 to receive or discharge a joint of pipe, the rotary 16 is rotated to bring the plunger 32 into position in the opening 50 below the cam 46. The latch handle 40 is then opened, which compresses and cocks the spring 80, and rotates the cam 46 away from the plunger 32 which then releases the connecting ends 28 and 30 of the rotary 16. The doors 12 and 14 are opened separating the connecting ends 28 and 30 of the rotary 16 allowing pipe to be inserted or removed from the interior of the rotary 16. However, the latch handle 40 will remain in the open or cocked position by the trigger 70. When desired, the doors 12 and 14 are then closed bringing the connecting ends 28 and 30 of the rotary into engagement, the pin 78 will unlock the trigger 70 and the springs 80 will automatically close the latch handle 40 as well as rotate the cam 46 against the plunger 32 to lock the connecting ends 28 and 30 of the rotary 16 together.

A further embodiment of the present invention is best seen in FIGS. 9 and 10 wherein the parts of the tong are numbered similarly to those in FIGS. 1 through 8 and like parts of the rotary plunger inserter are numbered similarly to those in FIGS. 1 through 8 with the addition of the suffix "a". Thus, a cam **46*a* is provided which is pivoted about a horizontal shaft 90 which is secured to a bracket 92 to the tong 10. A crank arm 94 connected to the cam 46*a* is connected to a link 96 which in turn is rotatably connected to a pin 98 which is secured to the latch handle 40. In operation when it is desired to open the tong 10 to receive or discharge a joint of pipe the rotary 16 is rotated to bring the plunger 32 into position in the opening 50 below the cam 46*a*. The latch handle 40 is then opened, which compresses and cocks the springs 80*a*, and pulls link 96 which vertically rotates the cam 46*a* around shaft 90 away from the plunger 32. As in the prior embodiment, the latch handle 40 will remain in the open or cocked position by the trigger 70*a* engaging the lug 76*a*. When desired, the doors 12 and 14 may be closed and the pin 78*a* will unlock the trigger 70*a* and the springs 80*a* will automatically close the latch handle 40 as well as move the link 96 and pivot the cam 46*a* downwardly to engage the plunger 32 and lock it to the connecting ends 28 and 30 of the rotary 16**.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a power pipe tong including doors with a latch handle and having a circular rotary having connecting ends for opening and closing for receiving pipe for make-up or break-out in which the connecting ends of the rotary are fastened together by a spring loaded plunger, the improvement in means for inserting the plunger into the connecting ends as the tong doors are closed comprising, a cam pivotally mounted on the tong and positioned for engagement with the top of the plunger for inserting the plunger into the rotary and for releasing the plunger, and a connecting linkage mechanism connected between the cam and the door latch handle and actuated by the handle for moving the cam into engagement with the plunger when the latch is closed and for moving the cam out of engagement with the plunger when the latch is opened.

2. The apparatus of claim 1 including, a spring biased trigger on one of the doors for engaging and locking the latch handle in the open position when the latch is opened, and a releasing pin on the other door for engaging and unlocking the trigger from the latch handle when the doors are moved to the closed position.

3. The apparatus of claim 2 including, actuating spring means positioned between the tong and the handle which is cocked when the handle is opened and which actuates the latch to the closed position and thereby actuates the cam when the doors are closed.

4. The apparatus of claim 1 wherein the connecting linkage includes, a connecting link pivotally connected to the handle, a crank pivotally connected to the link and to said cam.

5. The apparatus of claim 1 wherein the cam is rotatable in a horizontal direction and includes an incline for engaging and moving the plunger downwardly.

6. The apparatus of claim 1 wherein the cam is rotatable in a vertical direction.

7. In a power pipe tong including doors with a latch handle and having a circular rotary having connecting ends for opening and closing and receiving pipe for make-up or break-out in which the connecting ends of the rotary are fastened together by a spring loaded plunger, the improvement in means for inserting the plunger into the connecting ends as the tong doors are closed and preventing the plunger from becoming disengaged until the doors are opened comprising, a cam pivotally mounted about a vertical pivot for horizontal movement on the tong and positioned for engagement with the top of the plunger for inserting the plunger into the rotary and for releasing the plunger, a connecting linkage mechanism pivotally connected to the cam and to the door latch handle and actuated by the handle for moving the cam into engagement with the plunger when the latch is closed and for moving the cam out of engagement with the plunger when the latch is opened, actuating spring means positioned between the tong and the handle which is cocked when the handle is opened and which actuates the latch to the closed position and thereby actuates the cam when the doors are closed, a spring biased trigger on one of the doors for engaging and locking the latch handle in the open position when the latch is opened, and a releasing pin on the other door for engaging and unlocking the trigger from the latch handle when the doors are moved to the closed position.

8. The apparatus of claim 7 wherein the cam includes an incline for engaging and moving the plunger downwardly and includes a horizontal stop for holding the plunger in the engaged position.

9. In a power pipe tong including doors with a latch handle and having a circular rotary having connecting ends for opening and closing and receiving pipe for make-up or break-out in which the connecting ends of the rotary are fastened together by a spring loaded plunger, the improvement in means for inserting the plunger into the connecting ends as the tong doors are closed and preventing the plunger from becoming disengaged until the doors are opened comprising, a cam pivotally mounted about a horizontal pivot for vertical movement on the tong and positioned for engagement with the top of the plunger for inserting the plunger into the rotary and for releasing the plunger, a connecting linkage mechanism pivotally connected to the cam and to the door latch handle and actuated by the handle for moving the cam into engagement with the plunger when the latch is closed and for moving the cam out of engagement with the plunger when the latch is opened, actuating spring means positioned between the tong and the handle which is cocked when the handle is opened and which actuates the latch to the closed position and thereby actuates the cam when the doors are closed, a spring biased trigger on one of the doors for engaging and locking the latch handle in the open position when the latch is opened, and a releasing pin on the other door for engaging and unlocking the trigger from the latch handle when the doors are moved to the closed position.

* * * * *